US006401615B1

(12) United States Patent
Heinicke

(10) Patent No.: US 6,401,615 B1
(45) **Date of Patent: *Jun. 11, 2002**

(54) PRESS ROLLER WITH INTERCHANGEABLE EXTERNAL SLEEVE

(75) Inventor: Guenter Heinicke, Lienen (DE)

(73) Assignee: Windmoller & Holscher, Lengerich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/413,888

(22) Filed: Oct. 7, 1999

(30) Foreign Application Priority Data

Oct. 9, 1998 (DE) ..... 198 46 677

(51) Int. Cl.[7] ..... B41F 27/00
(52) U.S. Cl. ..... 101/389.1; 101/479
(58) Field of Search ..... 101/389.1, 401.1, 101/395, 376, 379, 479

(56) References Cited

U.S. PATENT DOCUMENTS

| | | | | |
|---|---|---|---|---|
| 4,144,812 A | * | 3/1979 | Julian | 101/382 R |
| 4,656,942 A | * | 4/1987 | Vertegaal et al. | 101/426 |
| 4,685,393 A | * | 8/1987 | Saueressig | 101/375 |
| 5,301,610 A | * | 4/1994 | McConnell | 101/401.1 |
| 5,845,574 A | * | 12/1998 | Dilling et al. | 101/351.6 |

FOREIGN PATENT DOCUMENTS

| | | |
|---|---|---|
| DE | 196 39 973 | 5/1997 |
| FR | 2 742 379 | 6/1997 |

* cited by examiner

*Primary Examiner*—Eugene Eickholt
(74) *Attorney, Agent, or Firm*—Jacobson Holman, PLLC

(57) ABSTRACT

A press roller exhibits an external interchangeable sleeve and an internal sleeve, which holds the external sleeve and which is provided with boreholes, which can be loaded with pressurized air, in order to facilitate the pulling on and off of the external sleeve. To feed the compressed air directly to the boreholes while avoiding buffer spaces that impede the pressure buildup, the boreholes are connected to compressed air lines, which are led through the interior of the internal sleeve.

18 Claims, 2 Drawing Sheets

PRESS ROLLER WITH INTERCHANGEABLE EXTERNAL SLEEVE

BACKGROUND OF THE INVENTION

1. Field of the Invention

The invention relates to a press roller with interchangeable external sleeve, whose internal sleeve, holding the external sleeve, is provided with boreholes, which can be loaded with pressurized air, in order to facilitate the pulling on and off of the external sleeve.

In printing machines the sleeves, provided with the printing plates or blocks, must be substituted in accordance with the different printing, jobs for the purpose of converting to the modified printing jobs. Furthermore, it can become necessary to interchange the sleeves of ink or anilox rollers. To interchange the sleeves it is necessary to provide auxiliary devices to expand the sleeves in the circumferential direction, because they sit with a press fit that is friction tight on the roller or an intermediate pipe.

2. Description of the Related Art

A prior art device for pulling block-bearing sleeves on and off a roller of a printing machine is explained with reference to FIG. 2 of the drawings.

FIG. 2 depicts a press roller 1, for example a form cylinder, onto whose internal sleeve 2 can be pulled an external sleeve (not illustrated), which bears, for example, blocks. To guarantee that the external sleeve sits with a press fit on the internal sleeve, the said external sleeve must be expanded in the circumferential direction when pulled on and off, in order to make the exchange even possible. The external sleeve is slid on the internal sleeve 2 in the direction of arrow A. To make the sliding on and pulling off process easy, the interior of the press roller 1 is provided with an inner cylinder 3, whose left side exhibits a central shaft journal 4, which is held in an axial borehole 5 of the left front disk 6, which is connected to the left shaft journal 7 of the press roller. On the right side the inner roller sleeve 2 is mounted by means of an annular recess on a disk 8, which is also connected to a shaft journal 9. The inside of the disk 8 exhibits a recess, which forms a circular disk 10, on which the sleeve of the inner cylinder 3 is mounted.

The right end of the sleeve 2 of the press roller is provided with boreholes 11, which are spaced apart over a circumferential line and which empty into a ring groove 12, which is recessed into the circumference of the disk 8. Furthermore, the sleeve 2 is provided with radial boreholes 13, which empty into the ring chamber 14 between the inner cylinder 3 and the sleeve 2.

The right shaft journal 9 is provided with an axial borehole 15, which extends into the front disk 8. The front disk 8 exhibits the axial borehole 15, from which extends the radial borehole 16, which empties into the ring groove 12. Furthermore, the radial borehole 16 runs eccentricly to the central line of the press roller through a borehole 17, which runs in the axial direction and empties into the ring chamber 14.

Compressed air is fed through the axial borehole 15 to the press roller for the purpose of sliding the external sleeve on and off. But to generate the requisite compressed air in the radial boreholes 11 and 13, the ring chamber 14 must be completely filled with compressed air. However, the ring chamber 14 is relatively voluminous so that it also forms a buffer for the fed-in compressed air and needs large quantities of compressed air in order to generate in the boreholes 11, 13 the pressure needed to expand the sleeve to be slid on and to form a cushion of compressed air, on which the expanded external sleeve can be slid on and pulled off.

SUMMARY OF THE INVENTION

Therefore, the object of the invention is to provide a press roller of the type described in the introductory part that has no buffer space impeding the pressure buildup so that the fed-in compressed air is directly and immediately available to expand the external sleeve to be slid on or to be pulled off and that generates a compressed air cushion, which improves the sliding properties.

The invention solves this problem with a press roller of the type described in the introductory part in that the boreholes are connected to compressed air lines, which are led through the interior of the internal sleeve.

In the press roller of the invention the radial boreholes of the internal sleeve are directly connected to the lines, introducing the compressed air, so that there is no dead space that has to be filled with compressed air, before the boreholes are loaded with air of the requisite pressure. Thus, to pull a sleeve on or off, one need only load the line, leading to the compressed air lines, with compressed air in order to feed the radial boreholes with compressed air.

A preferred embodiment provides that a shaft journal of the press roller is provided with an axial borehole, which is connected to the pipes, feeding the compressed air. To feed the boreholes with compressed air, the axial borehole is connected to a compressed air source.

It is expedient that the compressed air lines comprise pipes that are connected to the compressed air connection.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
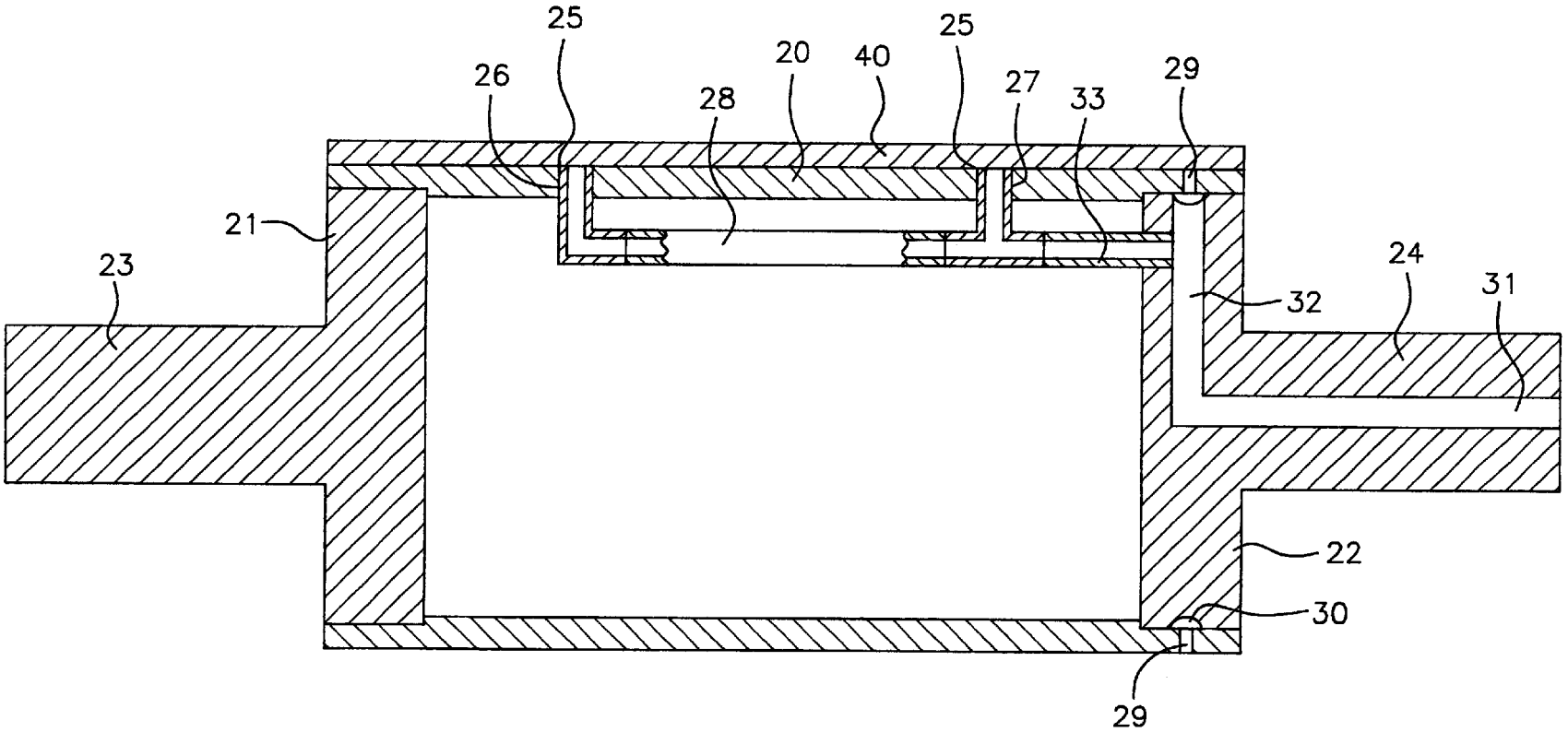
FIG. 1 shows a sectional view of a press roller, in accordance with the present invention.
Figure 2:
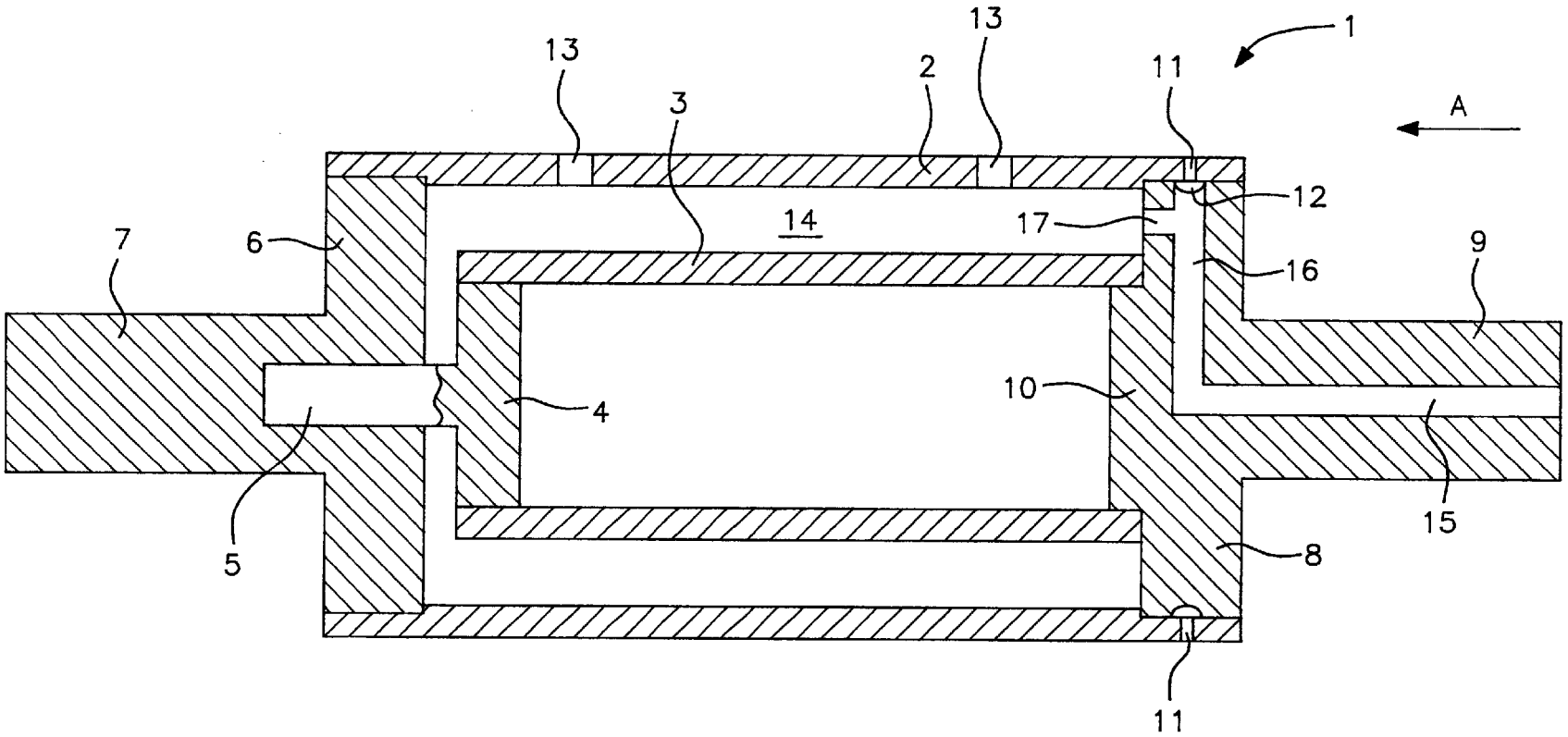
FIG. 2 (PRIOR ART)
FIG. 2 shows a sectional view of a press roller according to the prior art.

One embodiment of the invention is explained in detail below with reference to FIG. 1 of the drawings, which is a sectional view of a press roller, according to the invention.

The press roller, according to the invention, comprises an internal roller sleeve 20, onto which can be slid an external roller sleeve 40, which can bear blocks or is a roller sleeve of an anilox or inking cylinder. The roller sleeve 20 is connected on the front side by means of disks 21, 22, which are connect to said roller sleeve and which bear roller journals 23, 24 in the usual manner.

The sleeve 20 is provided with radial boreholes 25, into which are inserted pipe pieces 26, 27, which feed in compressed air from the interior. The piece of pipe 26 is L-shaped; and the piece of pipe 27 is T-shaped. The pipe pieces are connected together by a connecting piece of pipe 28.

On the right end the sleeve 20 is provided with radial boreholes 29, which follow in succession on a circumferential line and empty into a ring groove 30, which is recessed in the middle of the cylindrical peripheral wall of the disk 22.

The shaft journal 24 is provided with an axial borehole 31, from which a radial borehole 32 extends that empties into the ring groove 30. Parallel to the borehole 31 there is the disk 22 with a borehole, which empties into the radial borehole 32. Into this borehole is inserted a pipe piece 33, which forms the connection to the T-shaped pipe piece 27 in the manner illustrated. The pipe pieces 26, 27, 28 and 33 can be provided with connecting boreholes by cementing or welding together.

If an external sleeve is to be slid onto the roller sleeve 20 or pulled off the same, the boreholes 25, 29 or the mouths of the pipe pieces 26, 27 are put under compressed air by attaching the feed borehole 31 to a compressed air source.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A press roller comprising:

a cylindrical internal roller sleeve defining a substantially hollow center portion containing uncompressed air, said roller sleeve having at least one radial borehole and a diameter which is essentially constant throughout a length of said roller sleeve;

a first pipe piece inserted within said at least one radial borehole;

a connecting pipe piece connected to said first pipe piece, said connecting pipe piece running substantially parallel with and adjacent to an inner surface of said roller sleeve such that a majority of said hollow center portion remains open;

said connecting pipe piece being connected to a source of air pressure and directing compressed air through said first pipe piece within said at least one radial borehole to an outer surface of said roller sleeve for removal of an external sleeve fitted over said outer surface, the air in said hollow center portion remaining uncompressed during said removal.

2. The press roller as set forth in claim 1, further comprising:

a disk connected to one end of said roller sleeve, said disk bearing a shaft journal having an axial borehole parallel with said connecting pipe, said disk having a radial borehole extending from the axial borehole of said shaft and connecting with said connecting pipe such that compressed air passes through the axial borehole of said shaft journal, into said radial borehole of said disk, and into said connecting pipe.

3. The press roller as set forth in claim 1, wherein said external sleeve sits with an unsealed press fit on said roller sleeve, introduction of said compressed air through the radial borehole creating an air cushion enabling said external sleeve to be pulled off.

4. The press roller as set forth in claim 1, said roller sleeve including a plurality of radial boreholes connected to said connecting pipe piece for directing compressed air to said outer surface of said roller sleeve, said plurality of radial boreholes following a circumferential line around said roller sleeve and in alignment with a ring groove recessed in a peripheral wall of a disk connected to one end of said roller sleeve.

5. The press roller as set forth in claim 1, said roller sleeve including a plurality of radial boreholes following a circumferential line around said roller sleeve and in alignment with a ring groove recessed in a peripheral wall of a disk connected to one end of said roller sleeve for directing air against an underside of said external sleeve.

6. A press roller comprising:

an internal roller sleeve defining a substantially hollow center portion, said roller sleeve having a smooth outer surface and at least one radial borehole;

an interchangeable external sleeve for fitting over said smooth outer surface of said roller sleeve with an unsealed press fit;

a first pipe piece inserted within said at least one radial borehole;

a connecting pipe piece connected at a first end to said first pipe piece and running substantially parallel with and adjacent to said roller sleeve;

said connecting pipe piece being connected to a source of air pressure and directing compressed air through said first pipe piece within said at least one radial borehole and against an underside of said external sleeve for removal of said external sleeve, said compressed air escaping at ends of said external sleeve.

7. The press roller as set forth in claim 6, wherein said roller sleeve is cylindrical with a diameter which is equal over an entire length of said sleeve.

8. The press roller as set forth in claim 6, said roller sleeve including a plurality of radial boreholes in communication with said connecting pipe piece for directing compressed air to said outer surface of said roller sleeve, said plurality of radial boreholes following a circumferential line around said roller sleeve and in alignment with a ring groove recessed in a peripheral wall of a disk connected to one end of said roller sleeve.

9. The press roller as set forth in claim 6, further comprising:

a disk connected to one end of said roller sleeve, said disk bearing a shaft journal having an axial borehole parallel with said connecting pipe, said disk having a radial borehole extending from the axial borehole of said shaft and connecting with said connecting pipe such that compressed air passes through the axial borehole of said shaft journal, into said radial borehole of said disk, and into said connecting pipe.

10. The press roller as set forth in claim 6, further comprising:

a plurality of radial boreholes in said roller sleeve;

a plurality of pipe pieces inserted within said plurality of radial boreholes, respectively; and said connecting pipe piece connected to said plurality of pipe pieces so as to run substantially parallel with and adjacent to said roller sleeve.

11. The press roller as set forth in claim 10, wherein said plurality of pipe pieces have different axial positions and, each being relatively short due to a proximity of the connecting pipe piece to said roller sleeve, said plurality of pipe pieces supporting and reducing vibration in said connecting pipe piece.

12. The press roller as set forth in claim 6, wherein said connecting pipe piece extends adjacent only one surface of said roller sleeve and said first pipe piece extends to only said one surface.

13. The press roller as set forth in claim 9, said roller sleeve including a plurality of radial boreholes at said one end, said plurality of radial boreholes following a circumferential line around said roller sleeve and in alignment with a ring groove recessed in a peripheral wall of said disk, said ring groove in communication with said radial borehole of said disk such that, when said external sleeve is to be removed, compressed air is directed through said plurality of radial boreholes and against an underside of said external sleeve.

14. A press roller comprising:

an internal roller sleeve defining a substantially hollow center portion, said roller sleeve having a first plurality of radial boreholes for directing compressed air to an outer surface of said roller sleeve along a length thereof;

an interchangeable external sleeve for fitting over said roller sleeve;

a plurality of pipe pieces inserted within said first plurality of radial boreholes, respectively;

a connecting pipe connected to said plurality of pipe pieces and extending adjacent an inner surface of said roller sleeve;

a disk connected to one end of said roller sleeve, said disk bearing a shaft journal having an axial borehole, said disk having a radial borehole extending from the axial borehole of said shaft and connecting with said connecting pipe such that compressed air passes through the axial borehole of said shaft journal, into said radial borehole of said disk, into said connecting pipe, and through said first plurality of radial boreholes to said outer surface for removal of said external sleeve;

a second plurality of radial boreholes at said one end of said disk, said second plurality of radial boreholes following a circumferential line around said roller sleeve and being in alignment with a ring groove recessed in a peripheral wall of said disk, said ring groove in communication with said radial borehole of said disk, compressed air being directed through said second plurality of radial boreholes for removal of said external sleeve.

15. The press roller as set forth in claim 14, wherein said connecting pipe extends adjacent only one surface of said roller sleeve and said each of said plurality of pipe piece extends to only said one surface.

16. The press roller as set forth in claim 14, wherein said plurality of pipe pieces have different axial positions.

17. The press roller as set forth in claim 14, wherein said roller sleeve is cylindrical with a diameter which is equal over an entire length of said sleeve.

18. The press roller as set forth in claim 14, wherein said outer surface of said roller sleeve is substantially smooth and said external sleeve sits with an unsealed press fit on said outer surface.

* * * * *